United States Patent [19]

Kressin et al.

[11] 3,998,237

[45] Dec. 21, 1976

[54] COIN SORTER

[75] Inventors: John A. Kressin; Charles T. Bergman; Arnold R. Buchholz, all of Watertown, Wis.

[73] Assignee: Brandt, Inc., Watertown, Wis.

[22] Filed: Apr. 25, 1975

[21] Appl. No.: 571,860

[52] U.S. Cl. ..... 133/3 A; 133/8 R; 221/10

[51] Int. Cl.[2] ..... G07D 3/00

[58] Field of Search ..... 133/3 R, 3 A, 3 B, 3 E, 133/3 H, 8 R, 4 A; 221/156, 163, 167–171, 173, 10, 7, 8, 86, 82; 222/367, 370; 209/85; 194/9 R; 335/20 S

[56] References Cited

UNITED STATES PATENTS

| | | | |
|---|---|---|---|
| 2,581,074 | 1/1952 | Buchholz et al. | 133/8 R |
| 2,669,998 | 2/1954 | Buchholz | 133/8 R |
| 2,906,276 | 9/1959 | Blanchette et al. | 133/3 R |
| 2,977,961 | 4/1961 | Buchholz et al. | 133/3 R |
| 3,158,159 | 11/1964 | Weber | 221/86 |
| 3,218,506 | 11/1965 | Williams et al. | 335/20 S |
| 3,221,949 | 12/1965 | Dingus | 222/370 |

FOREIGN PATENTS OR APPLICATIONS

| | | | |
|---|---|---|---|
| 875,137 | 8/1961 | United Kingdom | 133/3 R |
| 802,550 | 10/1965 | United Kingdom | 133/3 B |

*Primary Examiner*—Robert B. Reeves
*Assistant Examiner*—H. Grant Skaggs
*Attorney, Agent, or Firm*—Quarles & Brady

[57] ABSTRACT

A coin sorter is disclosed in which coins deposited on a horizontal rotating disc are directed in single file to the circumference of the disc where the coins are removed, by denomination, by means of plows which lift one side of the coin so that the coins will fly off the disc. The removed coins enter chutes which lead to collecting stations which may be either a discharge spout or a count module. If the chute for a particular denomination of coins is directed to a discharge spout, a count of the coins is accomplished by use of a light and a photocell positioned on opposite sides of the path of travel of the coins as they leave the sorting disc and before they enter the discharge chute. If the chute for a particular denomination is directed to a count module, the coins are deposited on a rotating horizontal plate which carries the coins to a discharge passage and the coins are counted as they are forced through the discharge passage. The flow of coins from the count module is halted when a preset predetermined count for the particular denomination is reached. Coins are fed to the sorting disc by means of a rotating wheel having spaced circular sector shaped pockets in which coins are manually deposited. The wheel can be rotated, either one pocket at a time or continuously, to have the open pockets moved over an opening in a horizontal plate over which the wheel rotates. Coins in a pocket fall through the opening into an inclined chute which leads to the sorting disc.

6 Claims, 15 Drawing Figures

Fig. 6
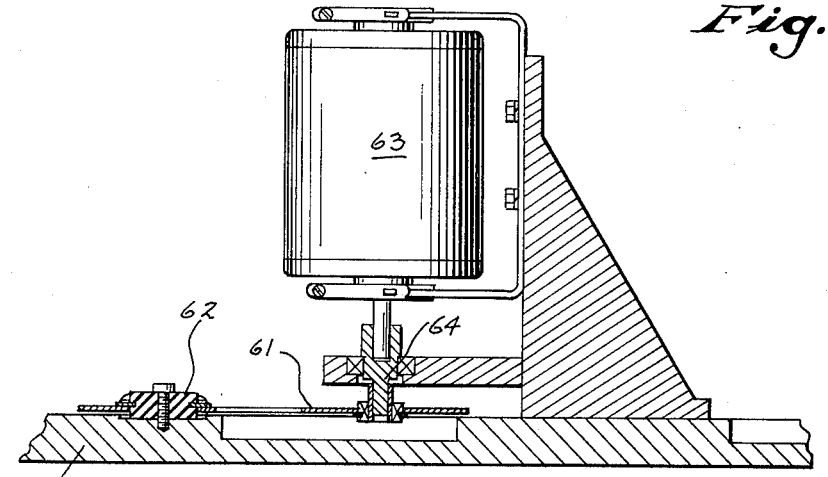
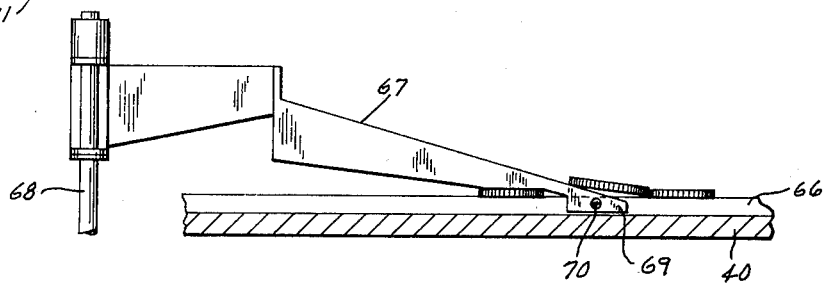
Fig. 7
Fig. 8
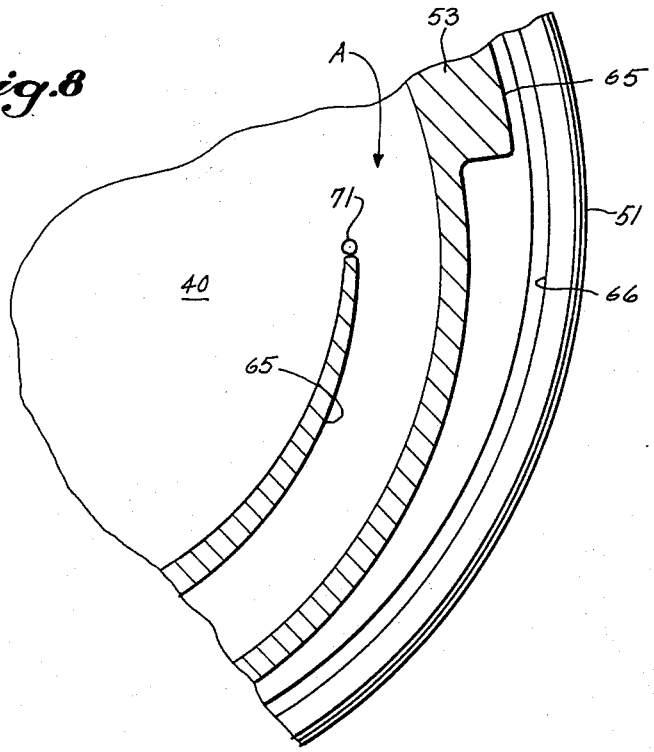

Fig. 9
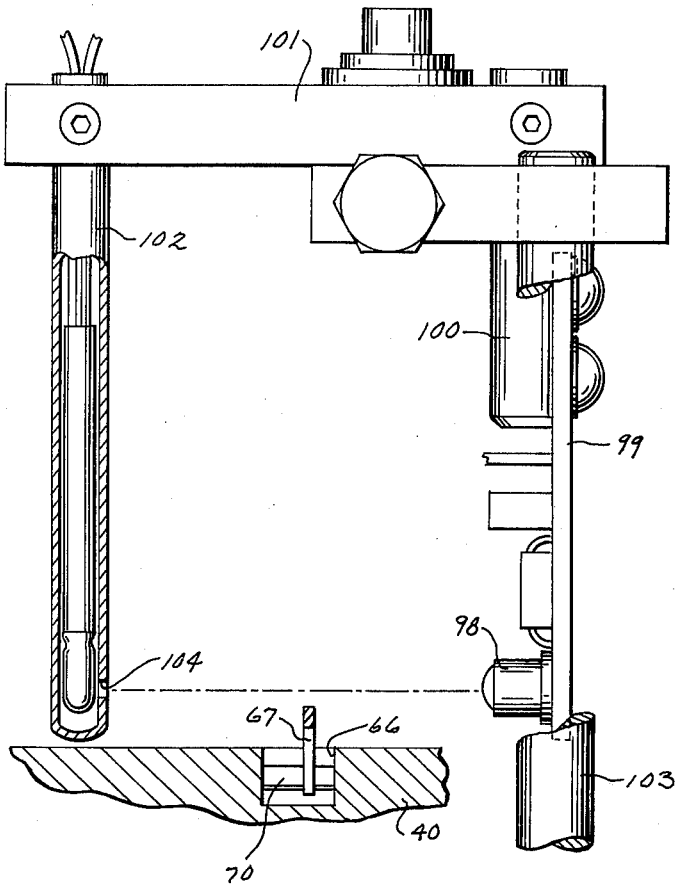
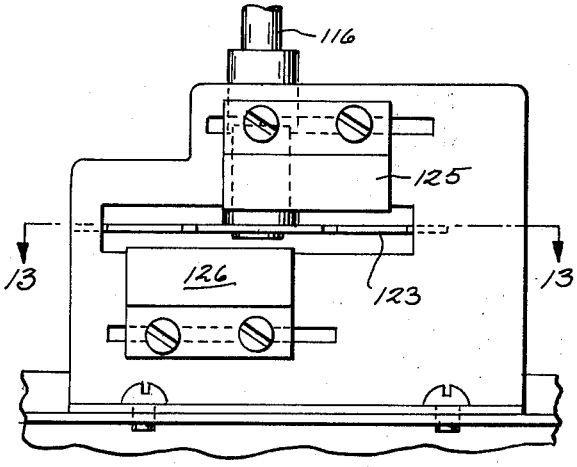
Fig. 12
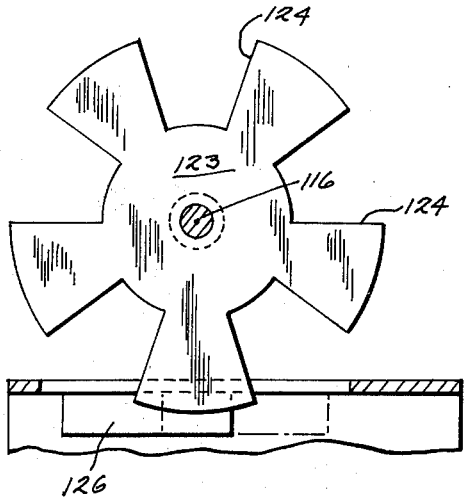
Fig. 13

COIN SORTER

Background of the Invention

1. Field of the Invention

The invention relates to the field of coin handling, and particularly to an apparatus for sorting and counting coins of various denominations.

2. Description of the Prior Art

Coin sorters are known in which coins of mixed denominations are placed on an inclined rotating disc having a scalloped edge and in which coins are carried upwardly by the scalloped edge and allowed to drop through an opening into a series of coin sorting slots. The slots form a series of channels with a series of graduated stops, one for each denomination of coins. The coins are rotated at the appropriate level, defined by a stop, past count sensors and are deposited in respective receptacles for each denomination. Examples of such inclined disc sorters are U.S. Pat. No. 2,642,882, dated June 23, 1953, and U.S. Pat. No. 2,835,260, dated May 20, 1958, and both issued to Arnold R. Buchholz. It is also known in such inclined disc sorters to provide means for totaling the count of all coins sorted and for displaying such total. Such a totalizer is the subject of U.S. Pat. No. 3,196,257, issued July 20, 1965 to Arnold R. Buchholz and Lawrence C. Anderson.

Coin sorters are also known which employ a horizontal rotating sorting disc which urges coins by centrifugal force against a rim of the disc where they can be diverted off, denomination by denomination. An example of such coin sorters is disclosed in U.S. Pat. No. 2,977,961, issued Apr. 4, 1961 to Arnold R. Buchholz and Frank Haban. This patent also discloses a conveyor feeder for delivering coins to the sorting disc.

Summary of the Invention

The present invention resides in a coin sorting apparatus which includes sorting means having a rotating sorting disc with means for removing coins by denomination from spaced positions along the circumference of the disc so that each denomination of coin will be directed to a respective collecting station for the particular denomination, together with means to supply batches of coins to the sorting disc, such means including a movable feeder having a plurality of spaced pockets which are open at the top and bottom, a horizontal plate beneath the feeder with an opening in the plate above the disc, and means for moving the feeder to advance the pockets successively to a position above said opening.

The invention may also reside in a coin sorter having a horizontal, rotating disc with an upstanding rim along its periphery and with a circumferential groove in its upper surface which is spaced radially inwardly of the rim, means for feeding batches of coins to the sorting disc, a spiral track above and facing the upper surface of the sorting disc to direct coins in single file to the rim of the disc, and a plow for each denomination of coin, the plows being spaced about the disc and each having a point disposed in the groove and held at a unique distance from the rim by a transverse pin extending from the point and riding the side walls of the groove.

The invention may further reside in a coin sorter having a sorting means with a horizontal rotating sorting disc and means for removing coins by denomination from the disc and directing the coins to a respective collecting station for each denomination, counter means disposed at one of the collecting stations, the counter means including a horizontal rotating plate for directing coins deposited on the plate to a discharge passage from which the coins are counted and ejected, feed means to supply the coins to the sorting disc, and first and second feed control means each including sensing means disposed above one of the sorting disc and plate and feed control switch adapted to be actuated by the respective sensing means, the actuation of a feed control switch halting operation of the feed means when a sensing means notes the accumulation of coins on the disc or plate above respective predetermined levels.

A coin sorter in accordance with the present invention is particularly suited for sorting coins from separated batches of coins, such as bags of coins which represent the collections from a particular vending machine or group of vending machines. By sorting, and at the same time counting, the contents of a bag a separate record can be kept of the contents of each bag. The mechanism for feeding coins to the sorting disc of the present invention allows the emptying of the contents of a particular bag or batch of coins into a separate pocket. The feeder can then be advanced to dump the contents of one pocket onto the sorting disc where the coins are sorted and counted after being sorted. Then the feeder can be advanced again to have the contents of the succeeding pocket sorted and counted. Alternately, the feeder may be continuously advanced, if separate counts of pocket contents is not needed, to provide a continuous supply of coins to the sorting disc.

Because of the form of sorting mechanism employed, the sorter is capable of operating at high speeds. The high speed operation is also achieved by the use of pulse generators for producing electrical signals for each coin of each denomination sorted so that the counting of coins proceeds rapidly.

Accordingly, objects of the invention include: the provision of means for feeding segregated batches of coins to a sorting mechanism and, alternately, for feeding coins continuously to the sorting mechanism; the provision of a high speed sorting and counting apparatus; the provision of a control for a batch coin feeder which will halt the feeder if the hand of an operator is about to be pinched by the feeder; the provision of a control for a sorter and counter feed mechanism which will halt the feeder if an excessive accumulation of coins is sensed in the sorting mechanism, or if an excessive accumulation of coins is sensed at a counting station for a particular denomination; and the provision of a count pulse generator which produces an electrical signal for each coin of a particular denomination as the coins fly off of a rapidly rotating sorting disc.

The foregoing and other objects and advantages will appear in the following detailed description of a preferred embodiment of the invention. In the description which follows, reference is made to the accompanying drawings.

Brief Description of the Drawings

FIG. 6 is a view in vertical section taken in the plane of the line 6—6 of FIG. 5, FIG. 7 is a side view in elevation of one of the plows which lifts coins of one denomination from the sorting disc;

FIG. 8 is a top plan view, taken from the plane of the line 8—8 of FIG. 4, of a portion of the sorting disc and illustrating, in section, a portion of the spiral coin track formed on the underside of a scroll plate mounted above the sorting disc;

FIG. 9 is a view in elevation, and partially in section, taken from the plane of the line 9—9 of FIG. 3, and illustrating one form of count pulse generator employed in the invention;

FIG. 12 is a view in elevation taken from the plane of the line 12—12 of FIG. 11;

FIG. 13 is a plan view taken from the plane of the line 13—13 of FIG. 12;

Description of the Preferred Embodiment

In general, the sorter includes a rotary feed mechanism in the form of a spoked wheel which deposits the contents of each open sector onto a horizontal, rotating sorting disc. The sorting disc sorts the coins by denomination and each denomination of coin exits from the sorting disc through a respective chute. The chutes may either direct the coins to a packaging outlet or to a count module for the denomination. If the coins of a particular denomination are directed to a packaging outlet, the count of the coins of that denomination is accomplished as the coins leave the sorting disc. If the chute leads to a count module, the coins are deposited on a horizontal rotating plate at the packager and are ejected seriatim with the count of the coins being accomplished as they are ejected. The counts for each denomination can be totalled and displayed on a console mounted on the top of the sorter.

Figure 1:
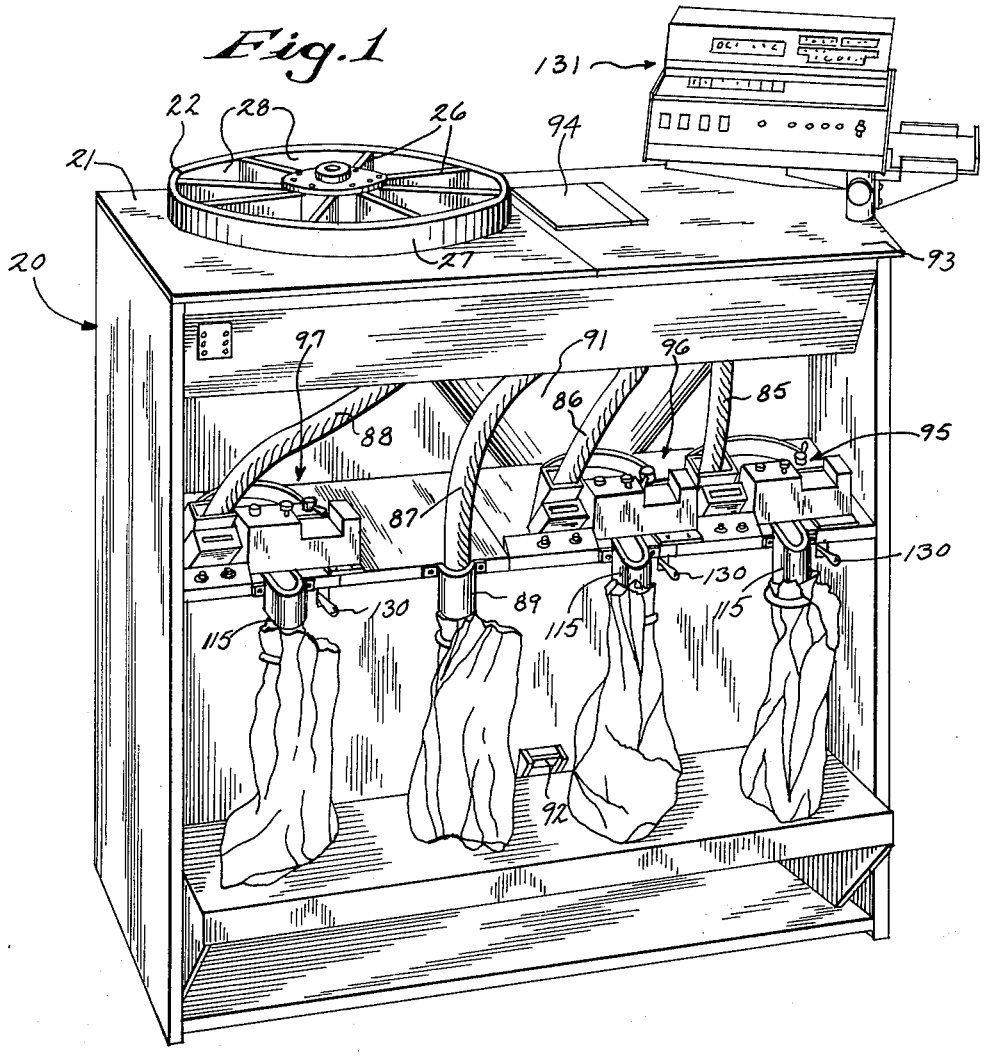
FIG. 1 is a view in perspective of a coin sorter in accordance with the invention.
Figure 3:
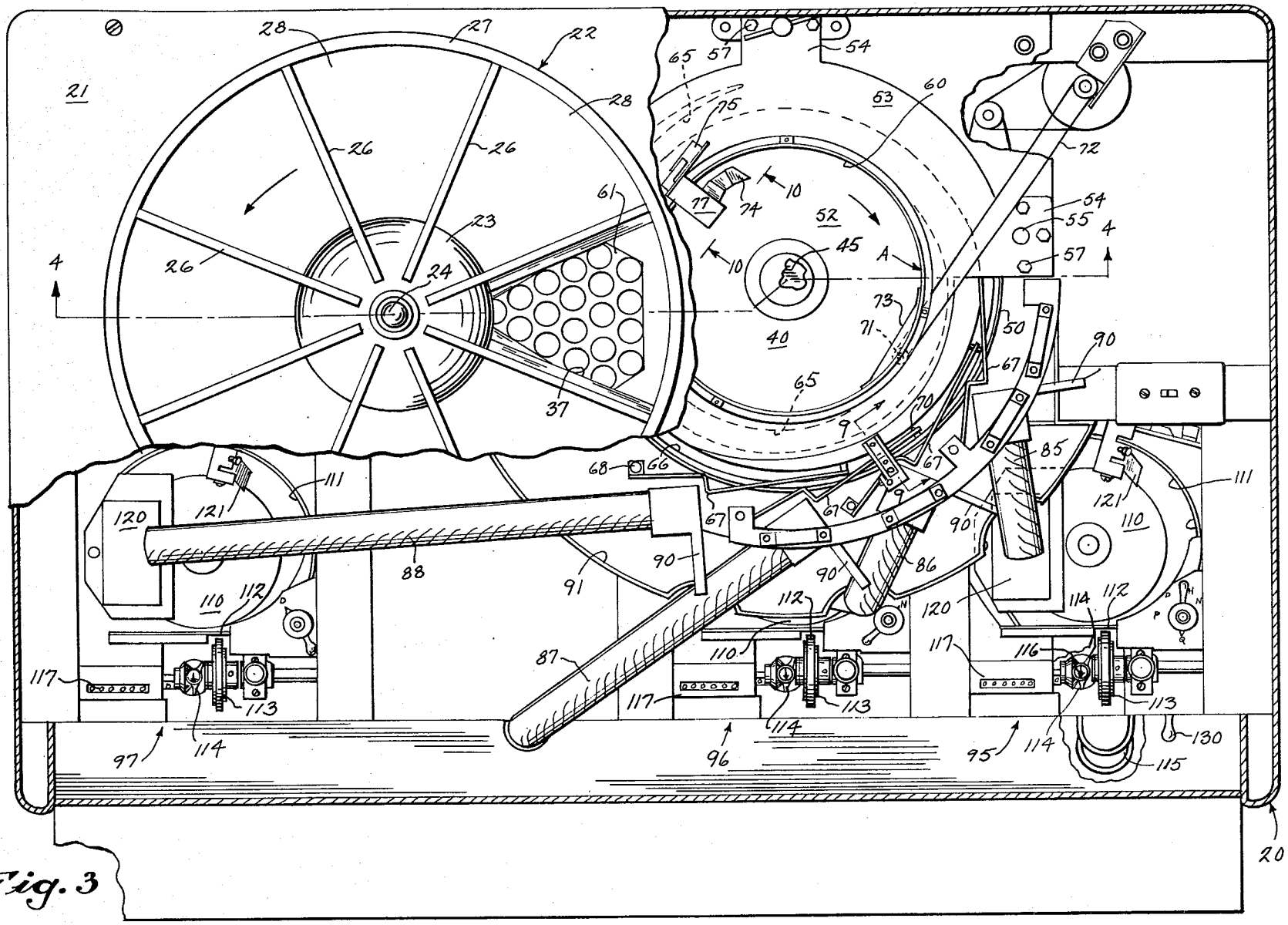
FIG. 3 is a plan view of the coin sorter with portions of the top of the housing removed and other parts broken away for purpose of illustration.
Figure 4:
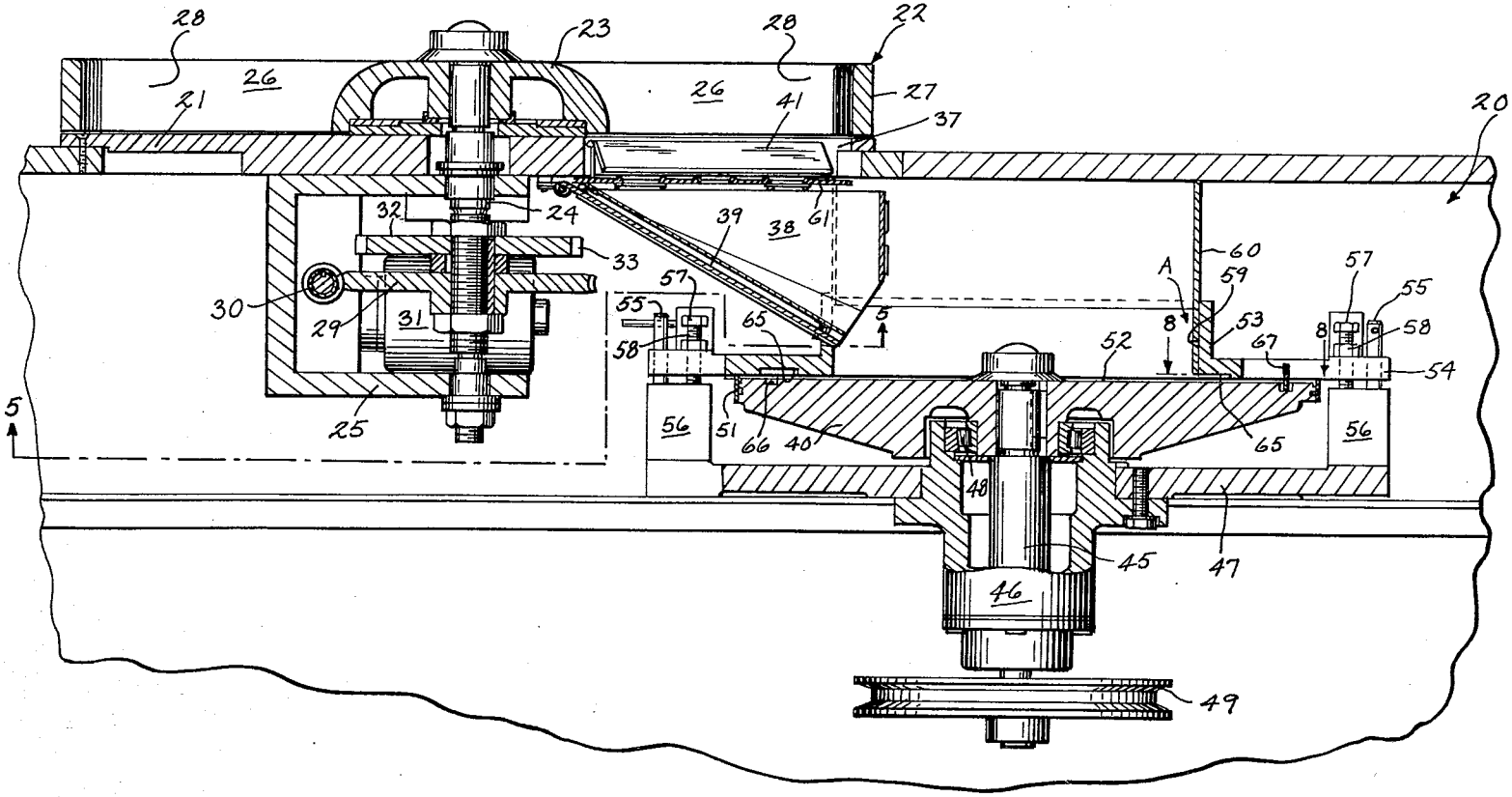
FIG. 4 is a view in vertical section taken in the plane of the line 4—4 of FIG. 3.

Referring to the drawings, and particularly FIGS. 1, 3 and 4, the sorter has a housing designated generally by the numeral 20 which surrounds an internal framework mounting the equipment. The housing 20 includes a left side top plate 21 which acts as a floor for a rotary feeder in the form of a spoked wheel 22. The hub 23 of the wheel 22 is mounted on the upper end of a shaft 24 extending through an opening in the top plate 21 and journaled in bearings held in a cage 25 beneath the top plate 21. A plurality of spaced, upright partitions 26 radiate from the hub 23 and are connected by a rim 27. A series of pockets 28 in the shape of circular sectors is thus formed between adjacent partitions. The pockets 28 are open at the top and bottom of the wheel 22.

Figure 5:
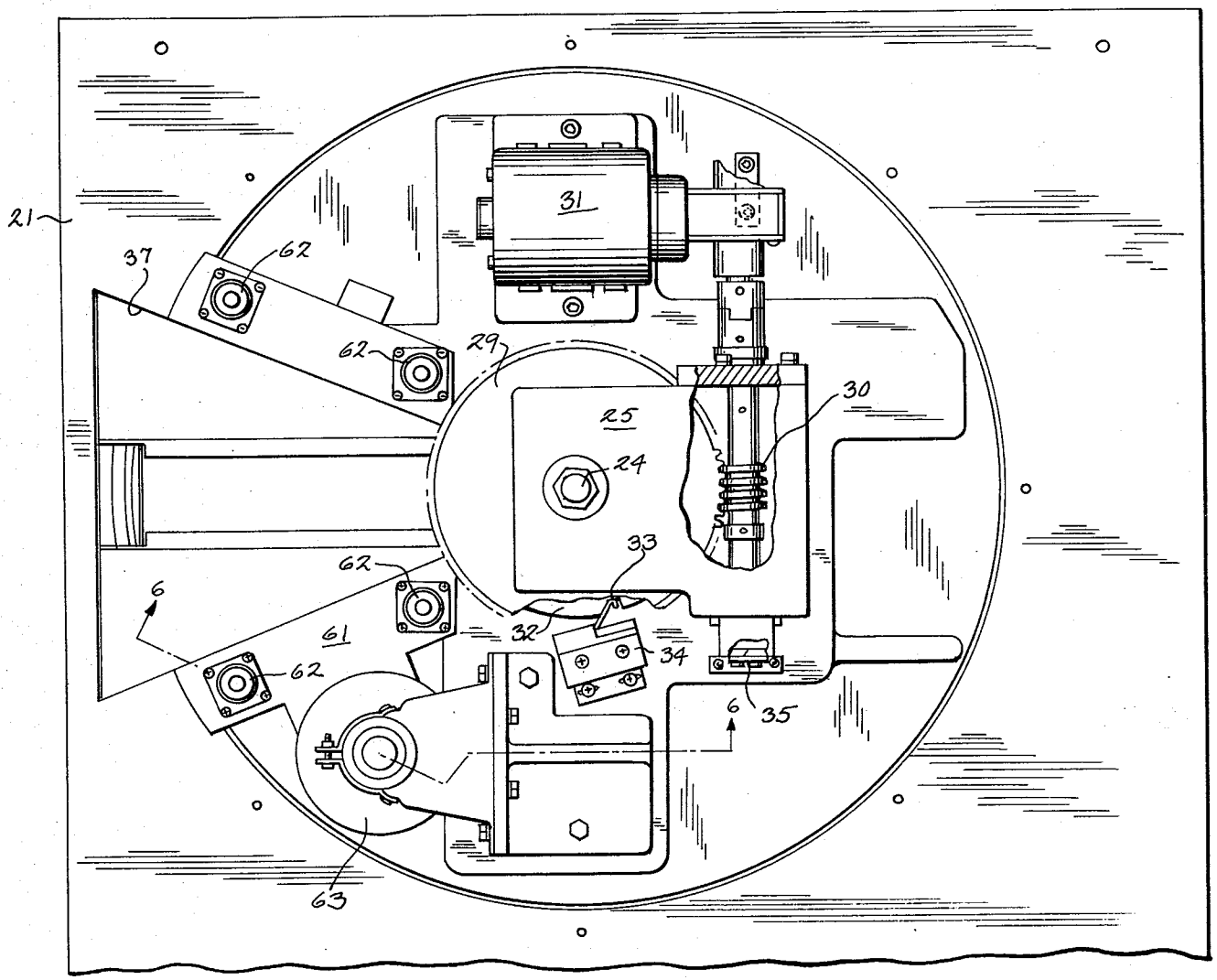
FIG. 5 is a bottom plan view taken from the plane of the line 5—5 of FIG. 4.

Referring to FIG. 5, the shaft 24 also mounts a worm gear 29 which meshes with a worm 30 which, in turn, is driven by a feed motor and reducer 31. Also keyed to the shaft 24 is a feeder cam 32 having a series of equally spaced recesses 33 in its outer periphery. The number of recesses 33 correspond to the number of pockets 28 in the wheel 22, which in the illustrated embodiment number eight. the actuator of a feeder switch 34 rides the periphery of the cam 32 and will enter a recess 33 to actuate the switch 34 each time the wheel 22 is rotated to advance one pocket 28. The shaft which mounts the worm 30 operates in a friction brake 35 so that rotation of the worm 30 will halt as soon as the motor and reducer 31 are deenergized.

The top plate 21 has an opening 37 corresponding generally in size and shape to the open bottom of each of the pockets 28. A feeder chute 38 has an inclined bottom 39 and leads from the opening 37 to direct coins which fall through the opening 37 onto a horizontally disposed, rotating sorting disc 40. In the preferred embodiment, in which provision is made to sort four denominations of coins, a perforate screen 61 extends across the opening 37. The screen 61 is provided with a plurality of circular openings which are large enough to pass the four smaller diameter U.S. coins (i.e. a quarter and smaller) but which are smaller than a half-dollar. So as to insure that coins will not bridge up over the openings in the screen 61 and prevent all coins of smaller denominations from falling into the chute 38 and onto the sorting disc 40, the screen 61 is mounted on flexible mounts and caused to vibrate so as to shake the coins disposed thereon. The four corners of the screen 61 are each mounted on a resilient pad 62 which is fastened at its center to the underside of the plate 21. A small electric motor 63 has its drive shaft connected to the screen 61 by means of an eccentric bushing 64 so that energization of the motor 63 will cause the screen 61 to vibrate.

In operation, the machine operator would dump a batch of coins, as from a bag, into one of the pockets 28 of the wheel 22 which is over the floor 21. The wheel 22 is then rotated, either one pocket at a time or continuously, to slide the contents of the loaded pocket over the surface of the top plate 21 and until the loaded pocket is over the opening 37 whereupon the coins, except the half-dollars, will fall through the openings in the screen 61, into the chute 38 and be deposited upon the rotating sorting disc 40. The half-dollars are manually removed from the screen 61.

To prevent injury to the operator by the accidental pinching of a hand or finger between the partitions 26 and the edge of the opening 37, a hinged finger trip plate 41 is mounted on the far edge of the opening 37. The finger trip bracket 41, when engaged with force by a foreign object such as the fingers of the operator, will be deflected downwardly and will actuate a finger trip switch 42 which is mounted behind the plate 41. Actuation of the finger trip switch 42 will, as explained later, halt rotation of the wheel 22.

The sorting disc 40 is keyed to the upper end of a drive shaft 45 journaled in a lower bearing mounted at the bottom of a drive shaft housing 46. The drive shaft housing 46 is suspended from an opening in a support plate 47 connected to the interior framework of the sorter. A roller bearing 48 is disposed in a counter-bore at the top of the drive shaft housing 46 and the sorting disc 40 has a hub portion which is journaled in the inner race of the roller bearing 48. The lower end of the drive shaft 45 mounts a pulley 49 which is connected by suitable belting to a separate sorting disc motor 50.

A rim 51 extends around the entire perimeter of the sorting disc 40 and extends slightly above the upper, flat surface 52 of the sorting disc 40. A scroll plate 53 is supported in a spaced relation above the upper surface 52 of the sorting disc 40, and is provided with three horizontally projecting ears 54 located at three points of the compass. The ears 54 are journaled on guide pins 55 which extend upwardly from blocks 56 mounted on the support plate 47. Elevating screws 57 with lock nuts 58 bear upon the tops of the blocks 56 and allow adjustment of the height of the scroll plate 53 above the upper surface 52 of the sorting disc, and control of the plane of the scroll plate 53 in relation to the plane of such upper surface 52. The scroll plate 53 has a central bore 59 and a ring extension 60 is disposed within the central bore 59 and extends upwardly. Coins travel down the feeder chute 38 into the opening defined by the ring extension and central bore of the scroll plate.

A spiral track is formed on the underside of the scroll plate 52. The spiral track 65 has a width which is slightly wider than the widest coin being handled and has a depth relative to the top surface 52 of the sorting disc 40 which is slightly greater than the thickest coin being handled. The entrance to the spiral track is at a point A, shown in FIGS. 3, 4 and 8. As the sorting disc 40 is rotated at a high rate of speed in a clockwise direction as viewed in FIG. 3, coins on the upper surface of the disc will be moved outwardly by centrifugal force towards the edges of the central bore 59 of the scroll plate 53. As the coins disposed along the edge of the central bore 59 reach the entrance to the spiral track 65 they will enter the spiral track in single file and be moved through the spiral track by the rotating action of the sorting disc. The spiral track will direct the coins, in single file, to the rim 51 of the sorting disc 40 where they are stripped off, denomination by denomination, in a manner which will now be described.

A circular groove 66 is formed in the upper surface 52 of the sorting disc at a distance spaced radially inwardly of the rim 51 of the disc. A plurality of plows 67 are mounted on the upright pins 68 at one end and project toward and over the circumference of the sorting disc 40. The points or tips 69 of the plows 67 ride in the circular groove 66 beneath the level of the upper surface 52 (see FIG. 7) and carry transverse pins 70 which engage the sides of the circular groove 66. The function of the plows 67 is to upset an inner edge of a coin held against the rim and cause the coin to be lifted off of the sorting disc and, due to the speed at which the coin is carried by the sorting disc, deflected towards a chute for each denomination. Since each of the plows 69 operate in the same groove 66 it is necessary that they be adjusted relative to the rim so that they will each remove only one coin of a single denomination. Such adjustment is accomplished by positioning the plow tip 69 axially upon its transverse pin 70. Each plow tip 69 thus occupies a unique radial position which is less than the diameter of the coin to be diverted and greater than the diameter of smaller coins. The plows will remove the denominations of coins in the order of their diameter. Thus, in handling U.S. coins including quarters, dimes, nickels and pennies, the quarter will be removed by the first plow, the nickel by the second plow and the penny and dime, respectively, by the next two plows.

As shown in FIG. 8, a point exists at the entrance to the spiral track 65 where coins could hang up on the point rather than be deflected either past the spiral track or into the spiral track. To eliminate this problem, a roller 71 is disposed at the point and the roller is driven by a belt 72 which connects to a pulley which in turn is driven by cooperating belts and pulleys from the sorting disc motor 50. A shroud 73 covers the belt 72 at its point of engagement with the roller 71 so that the belt is not subjected to engagement by coins on the disc. The shroud 73 is mounted on the inner bore of the scroll plate.

Figure 10:
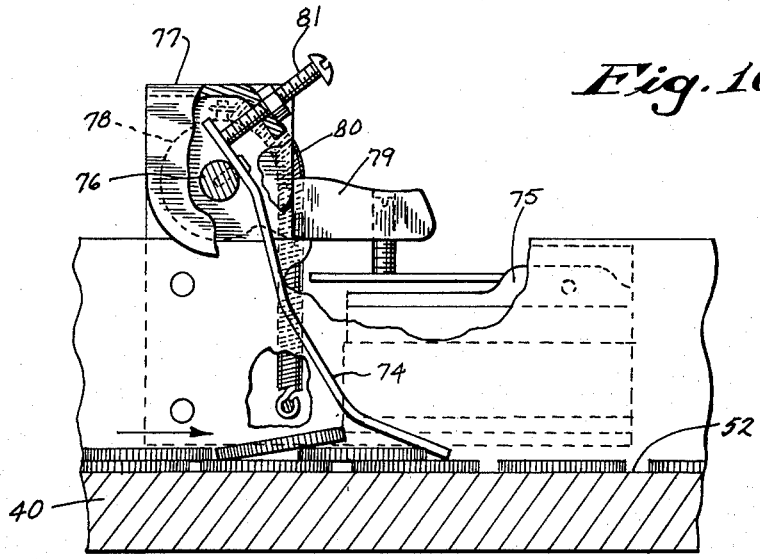
FIG. 10 is a view in elevation, and partially in section, of a coin level sensor mechanism for the sorting disc, and taken from the plane of the line 10—10 of FIG. 3.

A feed control paddle 74 is disposed within the open center of the scroll plate beyond the point of discharge of coins from the feed chute 38. The paddle 74 functions both to level the height of coins stacked on the sorting disc 40 and which are about to flow into the spiral track 65, and also to actuate a feed control switch 75 if the height of the coins stacked on the sorting disc 40 becomes excessive. As shown in FIG. 10, the feed control paddle 74 has its free end disposed above the level of the upper surface 52 of the sorting disc 40 and is mounted on a shaft 76 which is journaled in spaced flanges of a mounting bracket 77. The shaft 76 also mounts the hub 78 of an actuator arm 79 outboard of the mounting bracket 77 and a tension spring 80 is secured at one end to the hub 78 of the actuator arm 79 and at its other end is secured to the frame. The spring 80 urges the shaft 76 to rotate such that the free end of the paddle 74 is urged towards the upper surface 52 of the sorting disc 40. The height of the free end of the paddle above the upper surface 52 is adjusted by a set screw 81 which bears upon the opposite end of the paddle. Under the urgings of the spring 80, the paddle 74 will function to maintain a single layer of coins passing beneath it and thus, a single layer of coins being brought to the entrance of the spiral track. If, however, the paddle 74 is not able to maintain such a level of coins passing beneath it, thereby indicating an overload condition on the sorting disc 40 or a jam-up in the spiral track, the free end of the paddle 74 will be raised under the urgings of the coins passing beneath it and against the force of the spring to thereby rotate the actuator arm 78 in a counterclockwise direction as viewed in FIG. 10. This will open a normally closed feed control switch 75 by removing the force of the actuator arm 78 which normally bears against the switch arm.

When the coins are removed from the circumference of the sorting disc 40 by action of the plows 67, they will be deflected and directed towards a respective discharge chute in the form of a spirally wound, metallic hose for each denomination. Thus, the quarters will be directed towards a quarter hose 85, the nickels towards a nickel hose 86, the pennies towards a penny hose 87, and the dimes towards a dime hose 88. The hoses may extend from points adjacent the perimeter of the sorting disc 40 to either a count module or directly to a spout. In the embodiment illustrated, the quarters, nickels and dimes as directed through their respective hoses 85, 86 and 88 to the rotating plates of count modules while the pennies are directed by the hose 87 to a spout 89. Coins which leave the sorting disc but fail to enter the open ends of the hoses will hit deflectors 90 which extend laterally from the mouths of the hoses, and the coins will fall down into a flyoff bin 91 from which they are funneled to a coin cup 92 where they can be removed manually.

The right side top plate 93 of the sorter is a removable cover and it includes a hinged inspection door 94. The right side top plate 93 is removable for maintenance on the sorter mechanism and particularly to remove any jams which might develop.

As indicated, in the illustrated embodiment the quarters are directed by the hose 85 to a count module 95, the nickels are directed by the hose 86 to a count module 96 and the dimes are similarly directed by the hose 88 to a count module 97. The coins of these three denominations are counted at the count modules 95, 96 and 97. Since the pennies are directed by the hose 87 directly to a bagging spout 89, it is necessary to count the pennies at some point in their travel after being ejected from the sorting disc 40. This is accomplished by generating a count pulse for each coin by means of a photocell 98. Referring to FIG. 9, the photocell 98 is mounted on a receiver board 99 which is connected to a receiver support rod 100 which is held adjacent its upper end in a support block 101. A lamp tube 102 is adjustably held at its upper end in the projecting end of the support block 101 and the entire arrangement of the receiver board 99, the support pin 100, the support block 101 and the lamp tube 102, are mounted for vertical adjustment on a standard 103. The lamp tube has an aperture 104 through which a beam of light is directed towards the photocell 98 and each penny which is removed from the sorting disc 40 by action of the penny plow will break the light beam and thereby produce a count pulse.

The count modules 95, 96 and 97 are known per se and are of the type illustrated and described in U.S. Letters Pat. No. 3,246,658, issued Apr. 19, 1966, to Arnold R. Buchholz and William H. Sprenger for "Coin Counter Predetermined Count Control Apparatus" and assigned to the assignee of this invention. Reference should be had to such patent for details of the construction and operation of each count module.

Generally, the count modules each include a horizontal rotating plate 110 which forms the bottom of a hopper defined by an upstanding angular flange 111 and from which coins are carried by centrifugal force through an adjustable gate opening to a discharge channel 112. The coins enter the discharge channel in single file and are engaged seriatim by a rubber ejector wheel 113 and are forced past a starwheel 114 and out a bagging spout 115. The height and width of the adjustable gate opening are set for the thickness and diameter of the particular denomination being handled.

Figure 2:
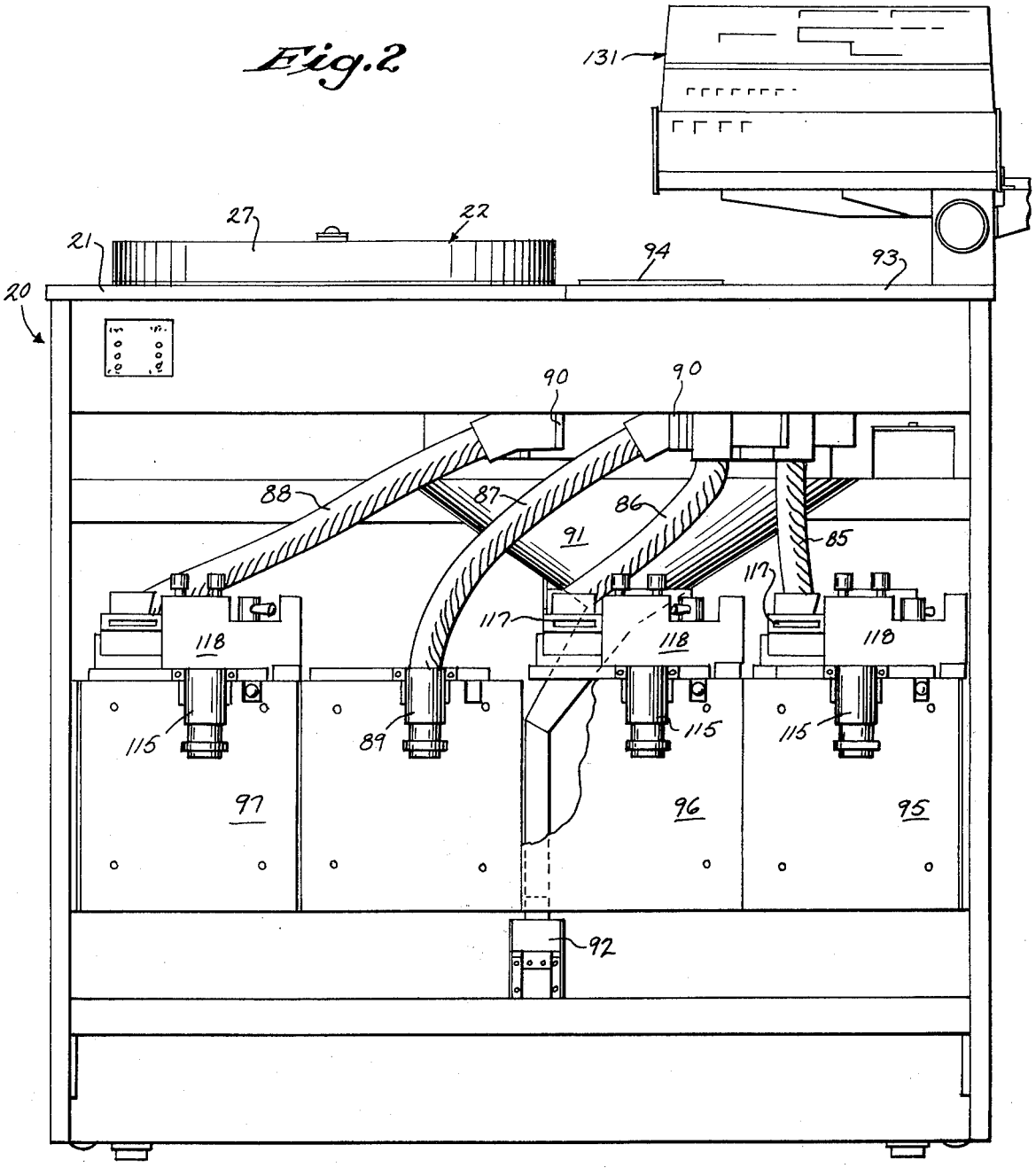
FIG. 2 is a front view in elevation of the coin sorter of FIG. 1.

The starwheel 114 is mounted on a vertical shaft 116 the rotation of which will produce a count pulse in a manner to be described. The shaft 116 is also connected by bevel gearing to a resettable counter 117. In FIGS. 1 and 2, the ejector wheel mechanism and starwheel are shown covered with a housing 118 whereas the housing is removed in FIG. 3. The count modules 95, 96 and 97 are identical, the only difference being the setting of the adjustable gate for the particular denomination of coins being handled by the count module.

Each of the hoses 85, 86 and 88 discharge the coins into a hopper 120 which is disposed to one side of the axis of rotation of the rotating plate 110 of the respective count module. A depending feed control arm 121 is mounted adjacent the flange 111 in each count module to assist in leveling the coins on the horizontal plate and to sense when the buildup of coins becomes excessive. The feed control arm 121 actuates a count module feed control switch 122, and the construction and operation of the feed control arm 121 is the same as that of the feed control paddle 74 operating on the sorting disc 40.

Figure 11:
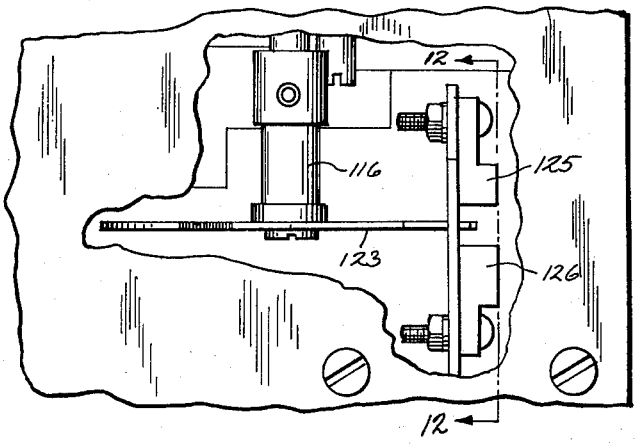
FIG. 11 is a view in elevation of a second form of count pulse generator employed in each count module.

Referring to FIGS. 11, 12 and 13, the bottom of the shaft 116 which mounts the starwheel 114 also mounts a rotary disc 123 formed of a magnetically conductive material such as steel. The disc 123 is provided with five equally spaced cutouts 124 and is adapted to be rotated in the space between a permanent magnet 125 and a reed switch 126. When a portion of the disc 123 is disposed between the magnet 125 and reed switch 126, it will act as a shield to prevent the magnet from closing the contacts of the reed switch. Since the disc 123 will be advanced one-fifth of a full revolution each time a coin is forced past the starwheel, for a period of the one-fifth revolution one cutout 124 will occupy the space between the magnet and the reed switch thereby permitting the magnet to cause the contacts of the reed switch to close. This results in the generation of a count pulse for each coin passing the starwheel 114.

As is known, the count modules may be operated so that upon receiving an electrical signal that a predetermined count of coins is about to be achieved, the count module will halt counting of coins when the last coin of the predetermined count is counted. Specifically, the halting of counting is accomplished by the deenergization of an ejector wheel solenoid 127 so that the ejector wheel 113 is tilted upwardly away from engagement with coins in the discharge channel. Since the force of the ejector wheel is removed, the flow of coins past the starwheel will stop. The deenergization of the ejector wheel solenoid 127 is controlled by a count stop switch 128 which is mechanically actuated by a bell crank lever when the lever is engaged with a lug projecting from the starwheel shaft 116. The bell crank lever is positioned to a point where it can be engaged by the lug on the starwheel shaft by means of a count stop solenoid 129 which is energized by the electrical signal indicating that the predetermined count is about to be reached. Also in a known manner, after the predetermined count has been reached and the count stop solenoid 129 deenergized, the bell crank lever can be normally reset to open the count stop switch 128 and reengage the ejector wheel for a subsequent predetermined count. The manual reset may be accomplished by a reset handle 130.

Figure 14:
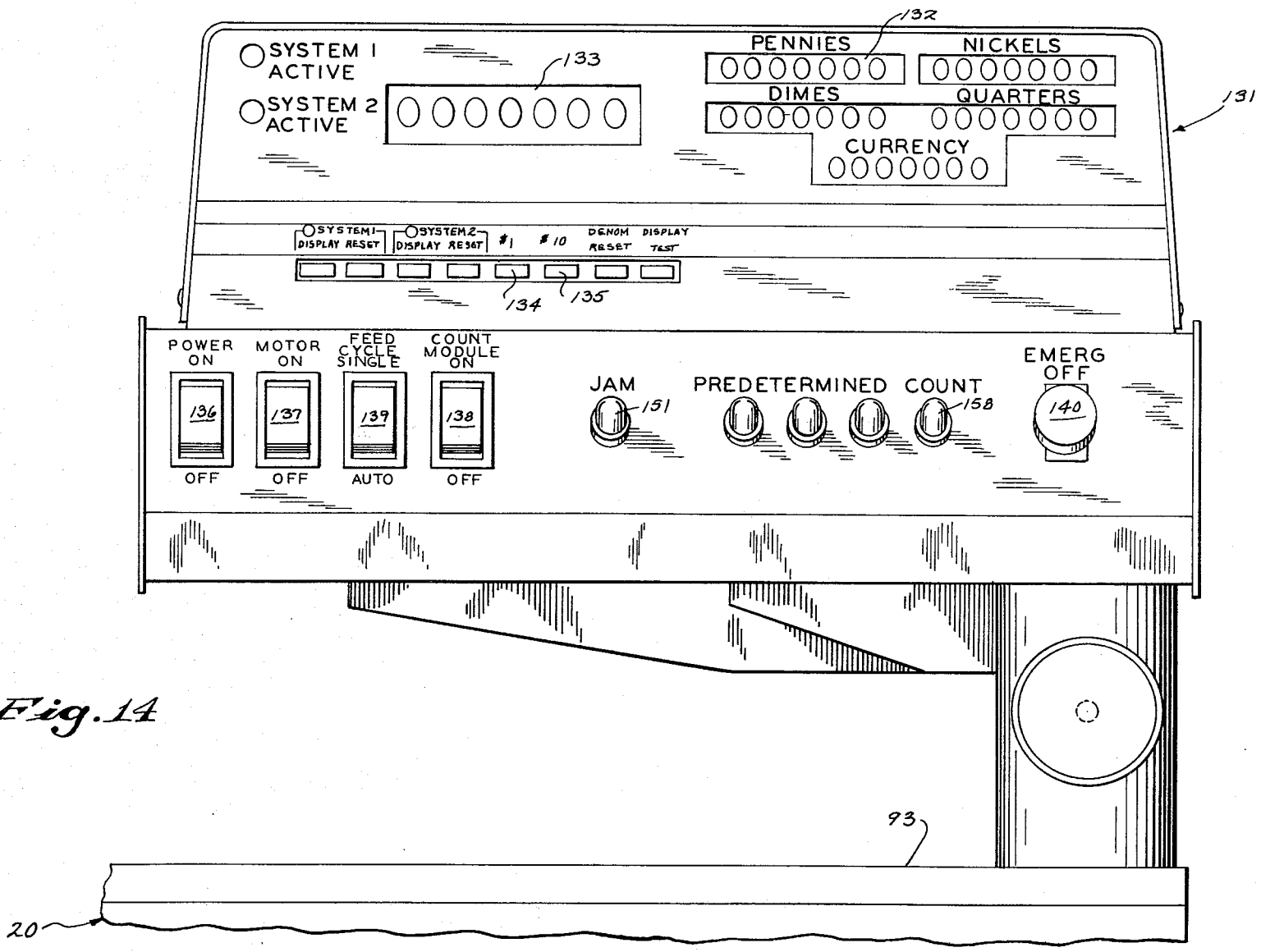
FIG. 14 is a view in elevation of a control console for the coin sorter.

Referring to FIG. 14, a control console 131 is adjustably mounted on an upright standard and held in place by a large hand screw. The control console 131 may be pivoted about the upright standard to set it at a desired position for the operator and to swing it out of the way for opening of the right side cover 93. The control console 131 includes visual displays for each of the denominations sorted and for currency. A typical visual display for pennies is identified by the reference number 132. The console also includes a visual display 133 for the total of the coin and currency counted.

The control console 131 includes a count totalizing circuit which may be similar to that shown in U.S. Pat. No. 3,196,257, issued July 20, 1965 to Arnold R. Buchholz and Lawrence C. Anderson for "Coin Valve Totalizer", and which will total the count of all monies being handled. Specifically, the totalizer includes five seven-digit counter-registers, one for each coin denomination and one for currency, together with the five seven-digit visual displays for each coin denomination counter-register and for the currency counter-register. The totalizer also contains two seven-digit counter-registers, identified as System I and System II, either one of which can be actuated to accumulate the total of coins and currency in dollars and cents together with the one seven-digit visual display 133 which displays, selectively, the contents of either System I or System II. The signal to the counter-registers of a count of a particular denomination of coins is provided by the pulse generators, either of the photocell type or the rotating shield reed switch type already described. The count of currency is manually entered through a pair of push buttons 134 and 135 contained on the console 131 by which the operator enters the value of currency as units of one or ten dollars.

Also located on the control console 131 are pairs of "display" and "reset" push buttons for each of System I and System II. In each case the "display" push button will display the contents of the respective system on the visual display 133 and will continue to hold the system displayed until the display button of the other system is depressed. The System I "reset" push button will reset the System I counter-registers to zero, as will the System II reset button. The denomination counter-registers may similarly be reset to zero by a manual push button labelled "denomination reset". There is also a "display test" push button which lights all segments of the visual displays when depressed to determine whether they are operating properly. The console also contains System I and System II "activate" lights which light to indicate that a particular system contains some accumulated count quantity other than zero. The control console also mounts control switches including: a power switch 136 which can be moved from neutral to either an "on" or "off" position; a motor switch 137 which can also be moved from neutral to an "on" or "off" position; a count module switch 138 which can be set to an "on" or "off" position; and a feed cycle switch 139 which can be set to a "single" position for a single pocket advance of the rotary feeder or to an "auto" position for continuous advance of the rotary feeder. An "emergency off" push button switch 140 is also mounted on the control console 131.

In operation, the machine operator would deposit the contents of each individual bag of money, which may include currency into one of the pockets of the wheel 22. The operator would remove any currency from the next pocket to be advanced over the opening 37. If the contents of the bag in that pocket is to be counted separately, the operator would cause the wheel 22 to advance one pocket by resetting one of the Systems I or II if the feed cycle switch 139 is set for single cycle operation. The pocket would be advanced over the opening 37 to discharge the coins onto the sorting disc 40. The operator would be entering the total amounts of the currency by use of the push button switches 134 and 135, and would remove from the screen 61 and similarly enter the total amount of half-dollars. The coins of that batch would be sorted and counted by denominations and the count pulses would be sent to the counter-registers for each denomination and to the total counter-registers where the totals would be visually displayed. The contents of the next pocket can similarly be sorted and counted separately, or the operator can choose to have the wheel 22 rotate continuously if separate counts are not needed.

For each denomination using a count module, the totalizer can be set to produce an electrical signal when a predetermined count of a bag quantity of coins of the particular denomination is reached. The bag quantity would be a multiple of one thousand coins and the operation of each count module would cease by removing the ejector wheel of that count module when the preset bag quantity has been reached. The operator must then remove the bag, replace it with a new bag, and reset the count module by means of the reset handle 130, in a known manner.

Figure 15:
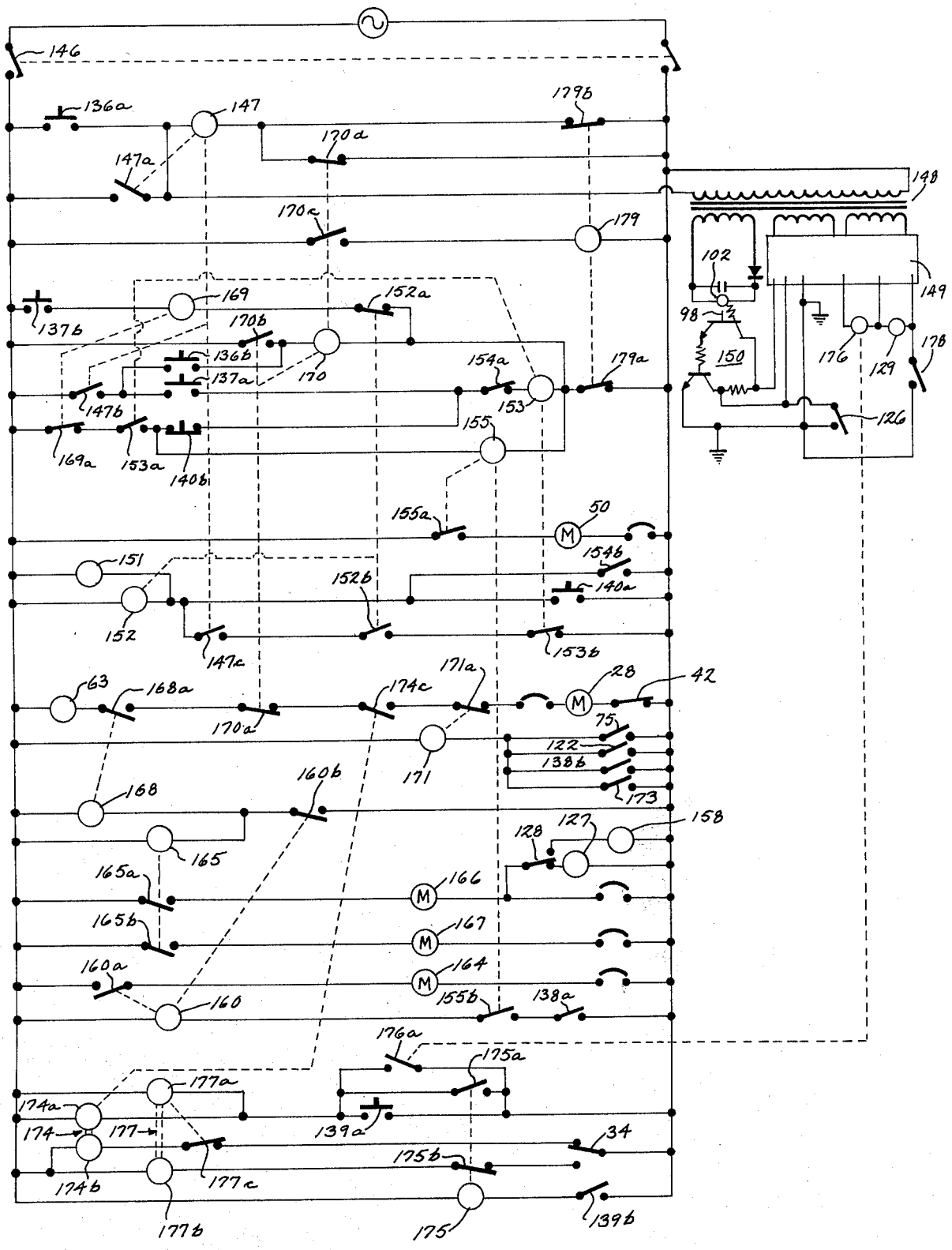
FIG. 15 is a schematic circuit diagram of the electrical control system of the coin sorter.

Referring to FIG. 15, closing the main on-off switch 146 provides alternating current power to the electrical system of the sorter. By momentarily actuating the power switch 136 to close the "power-on" contacts 136*a*, the coil of a relay 147 is energized thereby closing the normally open relay contacts 147*a* which thereby hold the relay 147 energized to provide power for the transformer 148 which services the totalizer 149 and the individual photocell circuits 150. Energization of the relay coil 147 also closes normally open contacts 147*b* to enable the "motor-on" circuitry, and closes normally open contacts 147*c* to enable the jam light 151 and the coil of a jam relay 152.

Then, momentarily actuating the motor switch 137 to close the "motor-on" contacts 137*a* will complete a circuit to energize the coil of a motor relay 153 so long as the normally open contacts 154*a* of a power interlock switch are closed indicating that the cover 93 is closed. Energization of the coil of the motor relay 153 will close the normally open contacts 153*a* thereby providing a holding circuit for the motor relay 153 after the motor switch 137 is released and also completing a circuit to energize the coil of a motor control relay 155. Energization of the motor relay coil 153 also opens normally closed contacts 153*b* which is in a holding circuit for the jam relay coil 152. The energization of the coil 155 of the motor control relay will close normally open contacts 155*a* to provide power to the sorting disc motor 50, and normally open contacts 155*b* will close to energize the coil 160 of a time delay relay so long as the "on" contacts 138*a* of the count module switch 138 are also closed.

Two seconds after the energization of the time delay relay coil 160, one set of contacts 160*a* will close providing power to the dime count module motor 164. Another set of normally open contacts 160*b* will close providing power to a count module relay 165 thereby causing its normally open contacts 165*a* and 165*b* to close and provide power to the nickel and quarter count module 166 and 167, respectively. Closing the normally open contacts 160*b* of the first time delay relay 160 also energizes the coil of a second time delay relay 168 which also provides a two-second time delay before its normally open contacts 168*a* are closed to thereby enable the rotary feed motor 28 and the vibrating screen motor 63.

The circuits which energize the count module motors 164, 166 and 167 will also energize the respective ejector wheel solenoid of each count module, of which solenoid 127 is typical. This is true unless the bag quantity at the particular count module has been reached, in which event the count stop switch, of which switch 128 is typical, will have been switched to open the circuit to the ejector wheel solenoid and close the circuit to a predetermined count light, of which light 158 is typical. Before the ejector wheel solenoid 127 can be energized to have the count module count coins of that denomination, it is necessary to manually reset the count module which will have the effect of placing the switch 128 in a position to energize the solenoid 127.

The rotary feed motor 28 will be energized to advance the wheel 22 if the normally closed contacts 170*a* of a power off relay 170 remain closed. This condition will exist so long as the motor off switch 137*b* is not closed and the power off switch 136*b* is not closed. A further condition which must be satisfied before the rotary feed motor 28 can be energized is the non-energization of a relay 171 whose normally closed contacts 171*a* are disposed in series with the feed motor 28. Relay 171 will be energized to prevent operation of the rotary feeder motor 28 if one of the following conditions exists: (a) the sorting disc is overloaded with coins thereby closing the feed control switch 75; (b) the similar count module feed control switch 122 of one of the count modules is closed indicating that the horizontal plate of the count module is overloaded with coins; (c) count module switch 138 has been switched off thereby closing the contacts 138*b;* or (d) one of the count modules is at the predetermined bag quantity, a condition indicated by the closing of an end of count switch 173.

If the foregoing conditions exist the feed motor 28 will be energized to rotate the wheel 22. However, if a finger or other obstruction becomes pinched in the opening in the left side top plate, the finger trip switch 42 will open thereby opening the circuit to the feed motor 28.

The wheel 22 will advance under the control of a latching relay 174 having a latching coil 174*a* and an unlatching coil 174*b*. The latching coil 174*a* will be energized by one of three methods. In the first method the feed cycle switch 139 is set at the single cycle position thereby closing the contacts 139*a* . In the second method, the feed cycle switch 139 is switched to the automatic position thereby closing the contacts 139*b* and energizing the coil of an automatic feed relay 175 causing normally open contacts 175*a* to close. The third method is the resetting of System I which energizes a relay coil 176 thereby closing normally open contacts 176*a*. Energization of the latching coil 174*a* closes the normally open contacts 174*c* thereby completing the circuit to the feed motor 28. Whenever the latching relay coil 174*a* is energized a latching relay coil 177*a* on a second latching relay 177 is also energized thereby opening the normally closed relay contacts 177*c*. As the rotary feeder begins its advance the arm of the switch 34 will move out of the recess in which it resided along the periphery of the cam 32 and will be switched to a position in which the unlatching coil 177*b* of the second latching relay 177 is energized to again close the relay contacts 177*c* so that when the rotary feeder has advanced one pocket and the arm of the switch 34 again reaches a recess 33 it will return to its normal closed position energizing the unlatching coil 174*b* of the first latching relay 174 thereby opening the relay contacts 174c and removing power to the feed motor 28. However, if the feed cycle switch contacts 139*b* are closed for automatic operation, so that the coil of the automatic feed relay 175 is energized, the relay contacts 175*b* will be open and the relay contact 175*a* will be closed with the result that the unlatching coils 174*b* and 177*b* can never be energized to open the circuit to the feed motor 28 regardless of the position of the switch 34. The wheel 22 will then continue to rotate until the feed cycle switch is switched to single cycle operation.

As the pennies fly off the sorting disc 40, the photocell 98 will sense the passage of each penny and the electrical pulse thus produced is amplified by the transistor circuit 150 and sent to the penny counter-register. As quarters, nickels and dimes are ejected from their respective count modules, each reed switch 126 will close for each coin and the electrical pulses thus produced are sent to the respective counter-register. When the predetermined bag quantity for one denomination of coin is about to be reached, an output signal is generated by the totalizer which energizes the count stop solenoid 129 so that the count stop switch 128 will be actuated at the end of the predetermined count to deenergize the ejector wheel solenoid 127 and prevent further counting of coins at that count module until a predetermined count reset switch 178 is closed to deenergize the count stop solenoid 129.

If a jam is experienced, or if the right hand cover 93 is opened for any reason, the jam disable circuit will stop all motors. In the case of a jam, momentarily actuating the emergency off switch 140 will close switch contacts 140*a* thereby energizing the jam relay coil 152. This will open normally closed relay contacts 152*a* to disable the circuit for the motor off relay 169 and will close the normally open contacts 152*b* to provide a holding circuit for the jam relay coil 152. The circuit to the motor relay coil 153 through the now opened emergency off switch contacts 140*b* will also open. The resulting deenergizing of the motor relay coil 153 will return the contacts 153*b* to their normally closed condition to provide the holding circuit for the jam relay coil 152 and will also open the relay contacts 153*a* to deenergize the motor control relay coil 155. This has the effect of opening the contacts 155*a* thus removing power from the disc motor 50 and from the first time delay relay coil 160. Then, the contacts 160*a* and *b* will again open to remove power to the count module motors 164, 166 and 167 and, by deenergizing the second time delay relay coil 169, will remove power from the feed motor 28. When the circuits are opened to the count module motors, power is also thereby removed from the ejector wheel solenoids. In this manner all motors and ejector wheels are stopped. A similar result is achieved if the cover is raised to open the power interlock switch to contacts 154*a* and to close the contacts 154*b*.

Restart of the motors can proceed by initially closing the motor on contacts 137*a* if the cover has been closed and the emergency off switch 140 has been reset. The motors of the sorter-packager can also be stopped, without turning off the totalizer circuitry, by using the "motor off" switch. That is, closing the "motor off" contacts 137*b* energizes the motor off relay coil 169 causing the normally closed relay contacts 169*a* to open to thereby remove the power to the motor relay 155 and motor control relay 153 with the same results as described above in the case of a jam.

To stop both the motors and the totalizer, the power off switch 136*b* is momentarily closed thereby energizing the coil 170 of the power off relay. This has the effect of closing normally open contacts 170*b* to provide a holding circuit, opening normally closed contacts 170*a* to disable the feed motor 28 circuit, closing normally open contacts 170*c* to energize a third time delay relay 179, and opening normally closed contacts 170*d* . After seven seconds the time delay relay 179 will open its normally closed contacts 179*a* thereby deenergizing the motor relay 153 and motor control relay 155. Deenergizing the relay 153 and 155 will, as explained above, remove power from the time delay relays 160 and 168, and from the count module relay 165, thereby removing power from the count module motors 164, 166 and 167, the feed motor 28, and the sorting disc motor 50. After the seven-second delay the normally closed contacts 179*b* will also open thereby opening the last remaining circuit for the relay coil 147. This removes all power to both the motors and totalizer.

As previously indicated, the coin sorter of this invention can be provided with coin count modules for each denomination to be sorted, or can be provided with discharge spouts at each coin collecting position. Alternately, there can be any intermediate combination of count modules and discharge spouts. The coin sorter also lends itself to adaptation for the handling of a mix of coins where the coins of a particular denomination will predominate. Thus, for some vending machine collections, the quantities of quarters may be disproportionately large and the quantities of another denomination, such as pennies, will be quite small. If such instances, two of the four available coin collecting stations may be devoted to count modules for handling quarters and the station which would otherwise be devoted to a collecting station or count module for pennies is eliminated to gain the extra station needed for quarters. Then, pennies which are removed from the circumference of the sorting disc would be deflected into the fly-off bin 91 and collected at the cup 92 rather than being deflected into the open end of a discharge chute. The discharge chute for quarters would then feed to a divider hopper in which the quantities of quarters would be split between two count modules for quarters. In a similar manner any number of possible combinations can be achieved.

The coin sorter may also advantageously employ a conveyor feeder fed by a coin hopper, of the general type disclosed in the aforesaid U.S. Pat. No. 2,977,961. The conveyor mechanism would deposit coins at the approximate position at which they fall from the chute 38 in the illustrated embodiment. The use of a conveyor feeder would, of course, replace the feed wheel mechanism of the preferred embodiment and would not provide for batch feed operations. The control of the operation of a conveyor feeder could be subject to the operation of the feed control paddle 74 and its associated feed control switch 75 which operate on the sorting disc and the similar feed control arms 121 and associated feed control switches 122 which operate on each of the count module horizontal plates 110.

In addition to visual display, the count stored in the counter-registers of the totalizer may also advantageously be transmitted to a printer to provide for a printout, upon operator request, of the totals of coin and currency accumulated in any or all of the counter-registers. Similarly, the totalizer can function as an input device to a digital computer so that the contents of the counter-registers may be transmitted to the computer for manipulation or storage in memory.

We claim:

1. In a coin sorting apparatus, the combination comprising:

sorting means including a rotating disc and means for removing coins by denomination from the circumference of said disc at spaced positions along said circumference;

discharge chutes for different denominations of coins with each chute leading from a respective one of the positions along said circumference to a collecting station for one denomination; and feed means to supply coins to said disc, said feed means comprising a rotary wheel having circumferentially spaced pockets therein which are open at the top and bottom of said wheel, a stationary floor disposed beneath said wheel and having an opening which conforms to the bottom opening of each of said pockets, said opening being disposed above said disc, a feed motor drivingly connected to said wheel to rotate said wheel so that the contents of a pocket will fall through said opening and be deposited on said disc, and circuit means for connecting said feed motor to a source of power, said circuit means including manually selectable means for causing said circuit to be closed to have said motor rotate said wheel through an arc sufficient to advance only one pocket over said opening and alternately for causing said circuit to be closed to have said feed motor continuously rotate said wheel.

2. A coin sorting apparatus in accordance with claim 1 wherein said feed motor is drivingly connected to a shaft which mounts said wheel, together with a sensing switch in said circuit and means connected to said shaft and operable upon said sensing switch to actuate the same when each single pocket advance of said wheel has been accomplished, said sensing switch controlling the opening of the circuit to said feed motor after said wheel has advanced one pocket, and said sensing switch being disabled when said manually selectable means is set for continuous rotation of said wheel.

3. A coin sorting apparatus comprising:

a horizontally disposed, rotating sorting disc having a flat upper surface and an upstanding rim along its periphery, said disc also having a circumferential groove in said upper surface spaced radially inwardly of said rim;

means for feeding batches of coins to be sorted to the upper surface of said sorting disc;

stationary spiral track means spaced above and facing said upper surface of said sorting disc, said track means being adapted to direct coins in single file from a point toward the center of said disc to said rim as said disc rotates; and a plow for each denomination of coins to be sorted, said plows being spaced about said sorting disc and each having a point which is disposed in said groove beneath the level of said upper surface, the point of each plow mounting a transverse pin the ends of which ride the side walls of said groove to hold the point of said plow at a radial distance from said rim which is unique for each denomination and which is less than the diameter of the denomination of coin to be engaged by said plow.

4. A coin sorting apparatus in accordance with claim 3 together with pulse generating means comprising a source of light and a photocell disposed on opposite sides of the path of travel of coins of one denomination which have been engaged by the respective plow and fly off said sorting disc.

5. In a coin sorting apparatus, the combination comprising:

sorting means including a horizontal rotating sorting disc and means for removing coins by denomination from the circumference of said disc at spaced positions along said circumference;

discharge chutes for different denominations of coins with each chute leading from a respective one of the positions along said circumference to a collecting station for said denomination;

counter means disposed at one of said collecting stations, said counter means including a horizontal, rotating plate for directing coins deposited on said plate to a discharge passage from which the coins are counted and ejected;

feed means to supply coins to said sorting disc, said feed means comprising a rotary wheel having circumferentially spaced pockets therein which are open at the top and bottom of said wheel, a stationary floor disposed beneath said wheel and having an opening which conforms to the bottom opening of each of said pockets, said opening being disposed above said disc, a feed motor drivingly connected to said wheel to rotate said wheel so that the contents of a pocket will fall through said opening and be deposited on said disc, and circuit means for connecting said feed motor to a source of power, said circuit means including manually actuable means for causing said circuit to be closed to have said feed motor rotate said wheel through an arc sufficient to advance only one pocket over said opening;

first feed control means including sensing means disposed above said sorting disc and a feed control switch connected in said circuit means and adapted to be actuated by said sensing means to open said circuit when a predetermined level of coins accumulates on said sorting disc; and second feed control means including a second sensing means disposed above said plate and a second feed control switch connected in said circuit means and adapted to be actuated by said second sensing means to open said circuit when a predetermined level of coins accumulates on said plate.

6. In a coin sorting apparatus, the combination comprising:

sorting means including a rotating disc and means for removing coins by denomination from the circumference of said disc at spaced positions along said circumference;

discharge chutes for different denominations of coins with each chute leading from a respective one of the positions along said circumference to a collecting station for one denomination;

feed means to supply coins to said disc, said feed means comprising a rotary wheel having circumferentially spaced pockets therein which are open at the top and bottom of said wheel, said pockets being defined by spaced vertical partitions radiating from a central hub, a stationary floor disposed beneath said wheel and having an opening which conforms to the bottom opening of each of said pockets, said opening being disposed above said disc, a feed motor drivingly connected to said wheel to rotate said wheel so that the contents of a pocket will fall through said opening and be deposited on said disc, and a circuit means for connecting said feed motor to a source of power; and a feeler plate pivotally mounted on the far edge of said opening and a switch connected in said circuit means and positioned to be actuated by the pivoting of said feeler plate to thereby open said circuit means, said feeler plate being adapted to be pivoted by an object being pinched between the edge of said opening and one of said partitions.

* * * * *